US010388252B2

(12) United States Patent
Lee et al.

(10) Patent No.: US 10,388,252 B2
(45) Date of Patent: Aug. 20, 2019

(54) DEVICE AND METHOD TO ADJUST DISPLAY BRIGHTNESS

(71) Applicant: SAMSUNG ELECTRONICS CO., LTD., Suwon-si (KR)

(72) Inventors: Heesae Lee, Yongin-si (KR); Donghoon Sagong, Suwon-si (KR); Minjung Son, Suwon-si (KR); KeeChang Lee, Seongnam-si (KR); Hyong Euk Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 340 days.

(21) Appl. No.: 15/206,820

(22) Filed: Jul. 11, 2016

(65) Prior Publication Data

US 2017/0110090 A1 Apr. 20, 2017

(30) Foreign Application Priority Data

Oct. 15, 2015 (KR) ..... 10-2015-0143875

(51) Int. Cl.
*G09G 5/10* (2006.01)

(52) U.S. Cl.
CPC ..... *G09G 5/10* (2013.01); *G09G 2320/028* (2013.01); *G09G 2320/066* (2013.01); *G09G 2320/0686* (2013.01); *G09G 2354/00* (2013.01)

(58) Field of Classification Search
CPC ..... G09G 5/10; G09G 2320/028; G09G 2320/066; G09G 2320/0686; G09G 2354/00
USPC ..... 345/690, 694
See application file for complete search history.

(56) References Cited

U.S. PATENT DOCUMENTS

| | | | | |
|---|---|---|---|---|
| 7,564,438 | B2 | 7/2009 | Kao et al. | |
| 2007/0285569 | A1 | 12/2007 | Nakamura et al. | |
| 2009/0167957 | A1* | 7/2009 | Joo | G09G 5/00 348/687 |
| 2010/0060554 | A1* | 3/2010 | Koh | G09G 3/3225 345/77 |
| 2015/0049003 | A1 | 2/2015 | Fujimaki et al. | |
| 2015/0054805 | A1* | 2/2015 | Lee | G09G 5/10 345/207 |

(Continued)

FOREIGN PATENT DOCUMENTS

| | | | |
|---|---|---|---|
| JP | 6-19444 | A | 1/1994 |
| JP | 2009-86133 | A | 4/2009 |

(Continued)

*Primary Examiner* — Amare Mengistu
*Assistant Examiner* — Gloryvid Figueroa-Gibson
(74) *Attorney, Agent, or Firm* — NSIP Law

(57) ABSTRACT

A method and device for adjusting a brightness of a display includes, determining current viewpoint brightness information of a current viewpoint region on the display corresponding to a user current viewed point or area of the display, determining previous brightness information of a previous viewpoint region of the display corresponding to a previously viewed point or area of the display, and controlling a displaying of a current image, including the current viewpoint region, with an adjusted brightness for a partial region of the display based on a comparison of the current viewpoint brightness information and the previous brightness information.

22 Claims, 9 Drawing Sheets

(56) References Cited

U.S. PATENT DOCUMENTS

| | | | | |
|---|---|---|---|---|
| 2015/0062191 | A1* | 3/2015 | Kim | G09G 3/3648 345/690 |
| 2015/0070337 | A1 | 3/2015 | Bell et al. | |
| 2015/0103059 | A1 | 4/2015 | Jung et al. | |
| 2015/0138073 | A1* | 5/2015 | Hennelly | G02B 27/0101 345/156 |
| 2015/0168723 | A1 | 6/2015 | Eto et al. | |

FOREIGN PATENT DOCUMENTS

| | | | |
|---|---|---|---|
| JP | 2011-22447 | A | 2/2011 |
| JP | 2014-182297 | A | 9/2014 |
| KR | 10-2014-0089345 | A | 7/2014 |
| KR | 10-2015-0025872 | A | 3/2015 |
| KR | 10-2015-0026029 | A | 3/2015 |

* cited by examiner

DEVICE AND METHOD TO ADJUST DISPLAY BRIGHTNESS

CROSS-REFERENCE TO RELATED APPLICATION(S)

This application claims the benefit under 35 USC § 119(a) of Korean Patent Application No. 10-2015-0143875, filed on Oct. 15, 2015, at the Korean Intellectual Property Office, the entire disclosure of which is incorporated herein by reference for all purposes.

BACKGROUND

1. Field

The following description relates to a device and method to adjust display brightness.

2. Description of Related Art

In general, a display device may be used for displaying an image on a television (TV), a notebook, a desktop computer, and the like. Since a display device may have limits as to number of lights that may be generated or used to display an image, the display device may display an image presenting a portion having a relatively high brightness or a portion having a relatively low brightness by adjusting a brightness of the image to compensate for such limits.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a method of adjusting a brightness of a display includes, determining current viewpoint brightness information of a current viewpoint region on the display corresponding to a user current viewed point or area of the display, determining previous brightness information of a previous viewpoint region of the display corresponding to a previously viewed point or area of the display, and controlling a displaying of a current image, including the current viewpoint region, with an adjusted brightness for a partial region of the display based on a comparison of the current viewpoint brightness information and the previous brightness information.

The method may further include adjusting the brightness for the partial region, including temporarily increasing the brightness of the partial region of the display in response to a difference between the current viewpoint brightness information and the previous brightness information meeting a light reaction threshold. The temporary increasing of the brightness of the partial region may include increasing the brightness of the partial region to a first amount beginning in a first light reaction interval, and gradually adjusting the brightness of the partial region to a default brightness during a second light reaction interval, after the first light reaction interval, longer than the first light reaction interval. The default brightness may be a normalized brightness level applied for different viewed points or areas of the display independent of location or time, representing a normalized physiological acclimation to different input light intensities. The first light reaction interval may be less than one second. The second light reaction interval may be less than ten seconds.

The temporary decreasing of the brightness of the partial region may include decreasing the brightness of the partial region to a first amount beginning in a first dark reaction interval, and gradually adjusting the brightness of the partial region to a default brightness during a second dark reaction interval, after the first dark reaction interval, longer than the first dark reaction interval. The default brightness may be a normalized brightness level applied for different viewed points or areas of the display independent of location or time, representing a normalized physiological acclimation to different input light intensities.

The method may further include adjusting the brightness for the partial region, including adjusting a brightness of a target region that includes the viewpoint region.

The method may further include determining the user current viewed point or area of the display by tracking a head and/or a gaze of the user, and determining the current viewpoint region based on the determined user current viewed point or area.

The method may further include adjusting the brightness for the partial region, including temporarily decreasing the brightness of the partial region of the display in response to a difference between the current viewpoint brightness information and the previous brightness information not meeting a dark reaction threshold.

The method may further include determining peripheral brightness information of a peripheral region, as the partial region, that is peripheral of the viewpoint region, wherein the controlling of the displaying of the current image with the adjusted brightness comprises adjusting a brightness of the peripheral region based on a comparison of the viewpoint brightness information and the peripheral brightness information. A radius of an outer radial edge of the peripheral region may be twice a radius of an outer radial edge of the viewpoint region. The adjusting of the brightness of the peripheral region may include decreasing the brightness of the peripheral region in response to a difference between the current viewpoint brightness information and the peripheral brightness information meeting a first emphasis threshold. The controlling of the displaying of the current image may further include controlling a displaying of a sequence of frames while maintaining a result of the decreasing of the brightness of the peripheral region until the peripheral region is no longer displayed or a viewpoint of the viewer changes.

The adjusting of the brightness of the peripheral region may include increasing the brightness of the peripheral region in response to a difference between the current viewpoint brightness information and the peripheral brightness information failing to meet a second emphasis threshold. The controlling of the displaying of the current image may further include controlling a displaying of a sequence of frames while maintaining a result of the increasing of the brightness of the peripheral region until the peripheral region is no longer displayed or a viewpoint of the viewer changes.

In another general aspect, a non-transitory computer-readable medium storing instructions that, when executed by one or more processors, cause the one or more processors to perform a method of displaying a brightness of a display, includes determining current viewpoint brightness information of a current viewpoint region on the display corresponding to a user current viewed point or area of the display, determining previous brightness information of a previous viewpoint region of the display corresponding to a previously viewed point or area of the display, and controlling a displaying of a current image, including the current viewpoint region, with an adjusted brightness for a partial region of the display based on a comparison of the current viewpoint brightness information and the previous brightness information.

In another general aspect, a device for displaying a brightness of a display includes a display configured to display plural images, and a processor configured to determine current viewpoint brightness information of a current viewpoint region on the display corresponding to a user current viewed point or area of the display, determine previous brightness information of a previous viewpoint region of the display corresponding to a previously viewed point or area of the display, and to provide for the display a current image, including the current viewpoint region, with an adjusted brightness for a partial region of the display based on a comparison of the current viewpoint brightness information and the previous brightness information.

In another general aspect, a method of adjusting a brightness of a display includes determining current viewpoint brightness information of a current viewpoint region on the display corresponding to a user current viewed point or area of the display, determining peripheral brightness information on a peripheral region that is peripheral of the viewpoint region, and controlling a displaying of a current image, including the current viewpoint region and the peripheral region, with an adjusted a brightness of a partial region of the display based on a comparison of the current viewpoint brightness information and the peripheral brightness information.

The controlling of the displaying of the current image may further include controlling the displaying of the current image with an adjusted brightness for the current viewpoint region of the display based on a comparison of the current viewpoint brightness information and the previous brightness information.

The method may further include adjusting the brightness of the partial region, including decreasing the brightness of the partial region in response to a difference between the current viewpoint brightness information and the peripheral brightness information meeting a first emphasis threshold. The controlling of the displaying of the current image may further include controlling a displaying of a sequence of frames while maintaining a result of the decreasing of the brightness of the partial region until the partial region is no longer displayed.

The method may further include adjusting the brightness of the partial region, including increasing the brightness of the partial region in response to a difference between the current viewpoint brightness information and the peripheral brightness information not meeting a second emphasis threshold. The controlling of the displaying of the current image may further include controlling a displaying of a sequence of frames while maintaining a result of the increasing of the brightness of the partial region until the partial region is no longer displayed.

The method may further include adjusting the brightness of the partial region, where the partial region is the peripheral region.

Other features and aspects will be apparent from the following detailed description, the drawings, and the claims.

Figure 1:
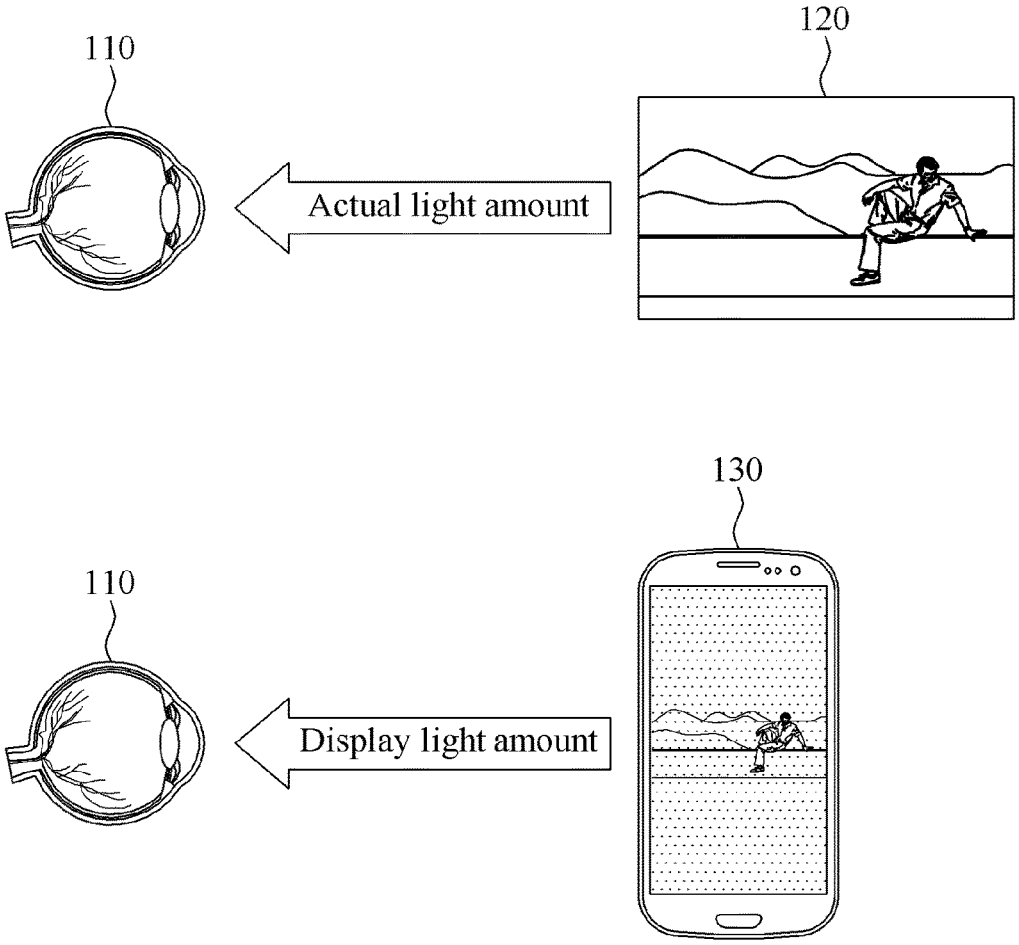
FIG. 1 is a diagram illustrating an example of a difference between a light amount incident to an eye in an environment and a light amount incident to an eye from a display according to one or more embodiments.

Throughout the drawings and the detailed description, unless otherwise described or provided, the same drawing reference numerals refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

The terminology used herein is for the purpose of describing particular examples only and is not to limit the examples. As used herein, the singular forms "a," "an," and "the" are intended to include the plural forms as well, unless the context clearly indicates otherwise. It will be further understood that the terms "include/comprise" and/or "have" when used in this specification, specify the presence of stated features, integers, steps, operations, elements, components, and/or combinations thereof, but do not preclude the presence or addition of one or more other features, numbers, steps, operations, elements, components, and/or groups thereof.

Unless otherwise defined, all terms including technical and scientific terms used herein have the same meaning as commonly understood by one of ordinary skill in the art to which examples belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

FIG. 1 is a diagram illustrating an example of a difference between an amount of light incident to an eye in a surrounding environment and an amount of light incident to an eye from a display according to one or more embodiments.

As noted above, there may be occasions when adjustments of image brightness are implemented to compensate for limitations of an underlying display, to provide the viewer an accurate image that is identical to the original stored or transmitted image. However, as discussed below, there may be alternatively or additionally occasions when adjustment of the image brightness are implemented, e.g., through either or both of adjustment of the image before display and adjustment of pixel brightness, to differentiate the displayed image from its original stored or transmitted image, or to differentiate select portions of the original stored or transmitted image, such as when a physiological response of changes in an image or a viewed portion of the image may be considered to provide a sense of reality and actuality to the viewer.

For example, as illustrated in FIG. 1, a substantial difference between light intensity incident to an eye 110 of a human body in an actual environment 120 and a display light intensity incident to the eye 110 from an electronic device 130 may exist. Hereinafter, an eye of a human body is referred to as an eye. For example, in the actual environment 120, light of approximately 100,000 lux may be incident to the eye 110 viewing the actual environment 120 in sunny weather. Conversely, the display light intensity emitted from a display included in the electronic device 130, for example, a television (TV) and a smartphone, may be less than approximately one tenth of the actual light intensity. Therefore, a user viewing the display may determine an apparent brightness level of an object represented on the display based on a color of the display rather than the display light intensity.

For example, an underexposure or an overexposure by a light intensity may partially occur in an image photographed in an area having a relatively high brightness or an area having a relatively low brightness, respectively. Correspondingly, a sense of reality and actuality could be sensed by the eye 110 if provided higher or lower brightnesses that mimic such overexposures or underexposures.

Figure 2:
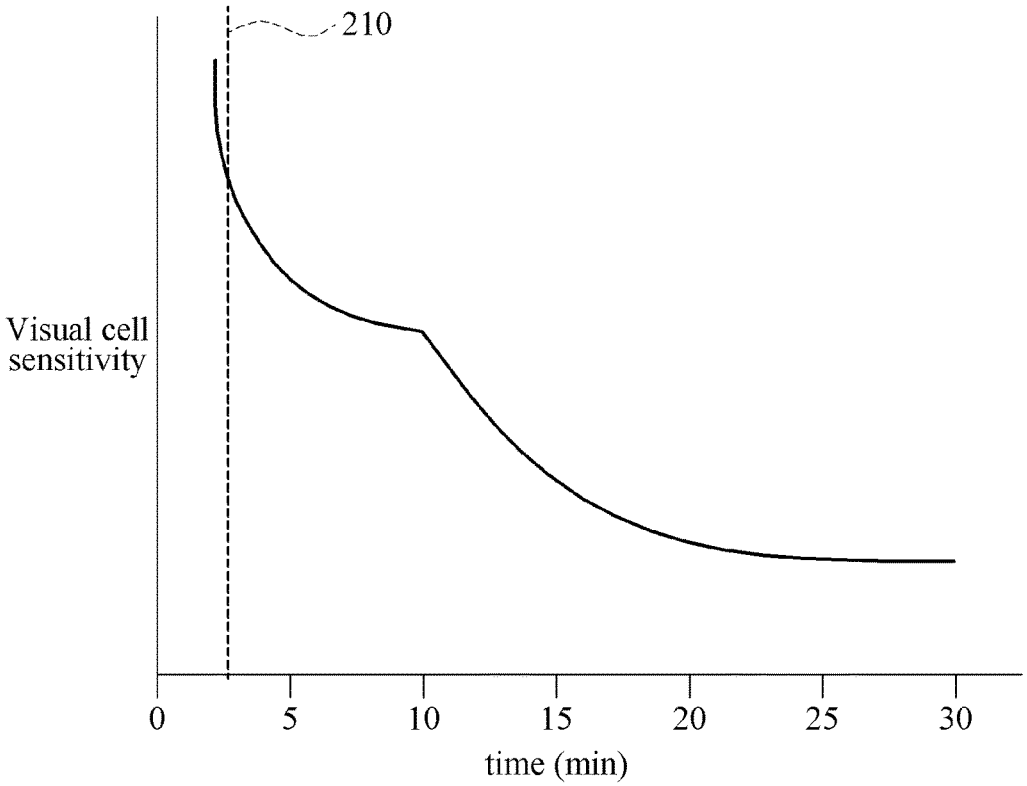
FIG. 2 is a graph illustrating an example of a change in a visual cell sensitivity with respect to a change of light intensity perceived by an eye of a human body according to one or more embodiments.

FIG. 2 is a graph illustrating an example of a physiological change or response in a visual cell sensitivity with respect to a change of light in an eye of a human body in accordance with an embodiment.

An eye requires an amount of time for adapting or acclimating in response to the eye instantly viewing a region having a relatively high brightness or a region having a relatively low brightness. For example, in response to the eye viewing the region having a relatively high brightness, a visual field may be gradually obtained subsequent to sensing glare, i.e., as the eye gradually becomes more accustomed to the sensed glare. Conversely, in response to the eye viewing the region having a relatively low brightness, the visual field may be gradually obtained subsequent to sensing darkness, i.e., as the eye gradually becomes more accustomed to the sensed darkness. FIG. 2 illustrates the visual cell sensitivity in response to the eye viewing the region having a relatively low brightness.

As illustrated in FIG. 2, the visual cell sensitivity may drastically change twice, or may occur through two phases or regions. The change of the visual cell sensitivity may occur due to a physiological difference between a cone cell and a rod cell, and the visual field may be obtained as time elapses. For example, as illustrated in FIG. 2, a human body may adapt to an instant strong light or darkness thereby obtaining the substantial visual field after a predetermined point in time 210. An adaptation to strong light refers to a light reaction, and an adaptation to darkness refers to a dark reaction. For example, the predetermined point in time 210 allowed for the eye to adapt to the strong light or darkness and obtain the visual field may be less than one minute.

In terms of a brightness having an identical intensity, the eye may recognize the brightness of a displayed image to be relatively low when viewed in an environment where a periphery has a relatively high brightness, and the eye may recognize the brightness of the displayed image to be relatively high when the periphery has a relatively low brightness. For example, the eye may further recognize a brightness of a current viewpoint or area of the displayed image by inferring the brightness based on a difference in contrast with periphery regions of the displayed image and the brightness of the current viewpoint or area of the displayed image.

In one or more embodiments, the brightness of the display may be exaggerated and represented by using the aforementioned physiological features or responses of the eye, such that a user may experience a realistic image through an instant brightness change and a difference in contrast with a relative brightness of the periphery.

Figure 3:
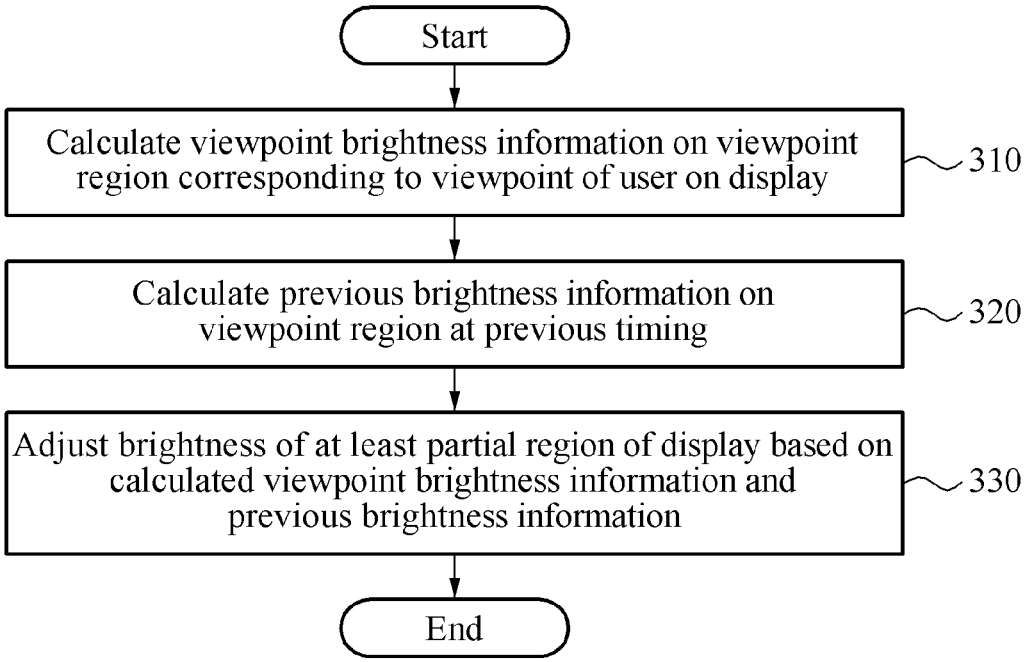
FIGS. 3 and 4 are flowcharts illustrating methods of adjusting a brightness of a display respectively according to one or more embodiments.
Figure 4:
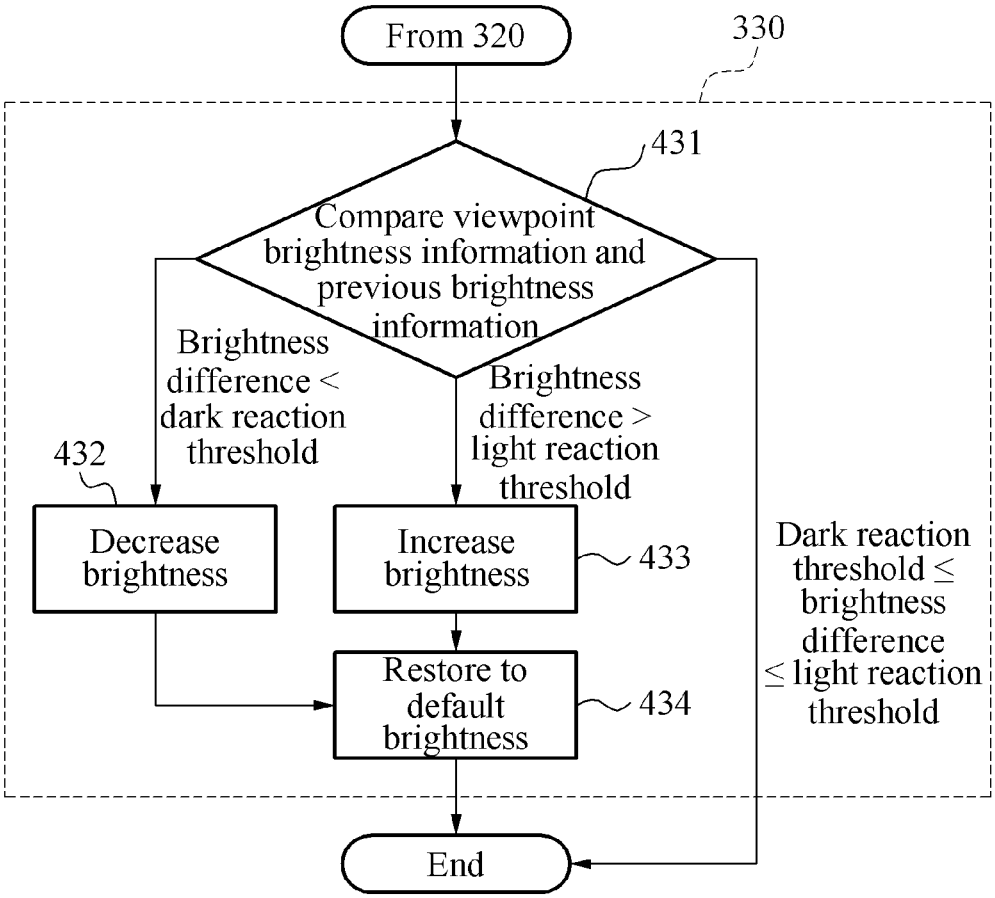

FIGS. 3 and 4 are flowcharts illustrating methods of adjusting a brightness of a display, respectively, in accordance with one or more embodiments.

FIG. 3 illustrates an example of the method of adjusting the brightness of the display. In operation 310, a processor of a device calculates viewpoint brightness information on a viewpoint region corresponding to a viewpoint of a user for an image on a display, such as a stored, transmitted, or a rendered image. Hereinafter, such a device for adjusting a brightness of a display will be simply referred to as a display brightness adjusting device. In an embodiment, the display brightness adjusting device may be a device that includes the display, or the display may be separate in a corresponding system.

A current timing refers to a timing corresponding to a present displaying operation. In an example, the current timing is referred to as a current frame in response to an image corresponding to a video including a plurality of frames. In another example, the current timing indicates a timing after a viewpoint has changed, in response to the user's viewpoint moving or changing on the display.

A viewpoint of a user refers to a point or area on the display viewed by the user at the current timing. In an example, since the user generally gazes at a center of the display, a processor determines a point corresponding to the center of the display as the viewpoint. In this example, while a gaze of the user is fixed to a predetermined region of the display, contents represented on the display may be changed due to a viewpoint change of a camera or viewpoint change of a rendered image. In an example, the processor determines the viewpoint on the display by tracking at least one of a head, eyes, or a gaze of the user.

The viewpoint region is a region the user intentionally views or gazes toward at the current timing. For example, the viewpoint region indicates a predetermined region on the display based on the viewpoint of the user. The viewpoint region may be represented by a circle area of the display, but it is not limited thereto. The viewpoint region may be provided in various forms, for example, a polygon. In a case in which the display brightness adjusting device is provided as a helmet mounted display (HMD), the viewpoint region may include an entire display of the HMD.

The viewpoint brightness information indicates information on a brightness of pixels corresponding to the viewpoint region at the current timing in an image displayed in the display. For example, the viewpoint brightness information may be an average value of the brightness of the pixels corresponding to the viewpoint region at the current timing, but it is not limited thereto. Various statistical values, for example, an intermediate value and a variance value, may be used. For example, the processor may calculate a brightness value of each pixel from color values, for example, red, green, and blue (RGB), or extract the brightness value in response to a pixel autonomously having the brightness value, e.g., such as YUV color space, or where brightness of pixels or are areas controllable independently of the underlining pixel colors.

In operation 320, the processor calculates or determines a previous brightness information on a viewpoint region at a previous timing.

The previous timing refers to a timing before the present point in time. For example, the previous timing indicates a previous frame in response to an image corresponding to a video including a plurality of frames. In another example, the previous timing indicates a timing before a viewpoint changes, in response to the user's viewpoint moving or changing on the display, for example.

The previous viewpoint indicates a viewpoint determined at the previous timing. As an example, the previous viewpoint indicates a viewpoint in a previous frame of a video playing on the display. In this example, in response to the fixed gaze of the user and/or fixed user orientation relative to the display, a position of a user's viewpoint may be identical on the display and only the contents represented/displayed at the corresponding viewpoint are changed by a viewpoint movement of a camera photographing the contents or virtual camera used to render the contents. In other words, when the user's gaze remains on a particular partial region of the display the user's viewpoint may not have changed, but the viewpoint of the camera or virtual camera may change resulting in changes to the displayed contents. In another example, in response to the user's viewpoint on the display moving or changing, the previous viewpoint on the display indicates a viewpoint before the movement or change. The viewpoint region of the previous viewpoint is referred to as the previous viewpoint region.

The viewpoint region at the previous timing is a region on the display determined based on the previous viewpoint. For example, the viewpoint region at the previous timing refers to a predetermined region on the display based on the previous viewpoint.

The previous brightness information indicates information on a brightness of pixels corresponding to the viewpoint region at the previous viewpoint in the image displayed on the display. For example, the previous brightness information indicates a statistical numerical value of the brightness of the pixels corresponding to the viewpoint region at the previous viewpoint.

In operation 330, the processor adjusts a brightness of at least a partial region of the display based on the calculated or determined viewpoint brightness information and the previous brightness information. Thus, brightness adjustment may be made based on the current viewpoint brightness information, e.g., the pre-adjusted brightness information for the underlying image, and the previous brightness information will be described in further detail with reference to FIG. 4.

FIG. 4 is a flowchart illustrating an example of the method of adjusting the brightness of the at least a partial region of the display based on the viewpoint brightness information and the previous brightness information, such as in operation 330 of FIG. 3, as only an example.

In operation 431, the processor compares the viewpoint brightness information and the previous brightness information. For example, the processor calculates a difference between the viewpoint brightness information of a current to-be display image or image portion and the corresponding previous brightness information for the previous viewpoint on the display or previous displayed image for the current viewpoint on the display, and compares the difference to a predetermined threshold or threshold value. The viewpoint brightness refers to a statistical or numerical value of the brightness of the pixels of an image to be displayed corresponding to the viewpoint region at the current timing, and the previous brightness refers to the statistical or numerical value of the brightness of such pixels corresponding to the same or different viewpoint region at the previous timing. Referring to FIG. 4, the threshold value includes a dark reaction threshold and a light reaction threshold. The processor may perform brightness adjustment based on a dark reaction in response to the difference between the viewpoint brightness information and the previous brightness information being less than the dark reaction threshold. Conversely, the processor may perform the brightness adjustment based on a light reaction in response to the difference being greater than the light reaction threshold.

In operation 432, the processor temporarily decreases the brightness of at least a partial region in response to the difference between the viewpoint brightness information and the previous brightness information being less than the dark reaction threshold. For example, the processor decreases the brightness of at least a partial region during a first dark reaction interval, such as illustrated in FIG. 2.

In operation 434, the processor restores the brightness of the at least a partial region to a default brightness. For example, the processor may gradually restore the brightness of the at least a partial region to the default brightness during a second dark reaction interval longer than the first dark reaction interval after the first dark reaction interval. In this example, the first dark reaction interval and the second dark reaction interval are referred to as a temporal length.

For example, the first dark reaction interval may be set as a relatively short interval, for example, a temporal length close to zero seconds, such as less than two seconds. The second dark reaction interval may be set as a temporal length less than ten seconds. However, the temporal lengths of the first dark reaction interval and the second dark reaction interval are not limited thereto. The temporal lengths of the first dark reaction interval and the second dark reaction interval may be varied as desired.

As an example, the processor adjusts a brightness of a target region including the viewpoint region. The processor decreases the brightness of the target region during the first dark reaction interval and gradually restores the decreased brightness during the second dark reaction interval to a default brightness or corresponds to the aforementioned current viewpoint brightness information, such that a user viewing the target region may indirectly realize the dark reaction.

In operation 433, the processor temporarily increases the brightness of at least a partial region in response to the difference between the viewpoint brightness information and the previous brightness information being greater than the light reaction threshold. For example, the processor increases the brightness of at least a partial region of the display during a first light reaction interval.

In operation 434, the processor restores the brightness of the at least partial region to the default brightness. For example, the processor gradually restores the brightness of the at least partial region to the default brightness, or corresponding to the aforementioned current viewpoint brightness information, during a second light reaction interval longer than the first light reaction interval after the first light reaction interval. In this example, the first light reaction interval and the second light reaction interval are referred to as a temporal length.

For example only, the first light reaction interval may be set as a relatively short interval, for example, a temporal length close to zero seconds, such as less than 0.5 seconds. The second light reaction interval may be set as a temporal length less than ten seconds. However, the temporal lengths of the first light reaction interval and the second light reaction interval are not limited thereto. The temporal lengths of the first light reaction interval and the second light reaction interval may be changed based on a design.

The processor increases the brightness of the target region of the display during the first light reaction interval and gradually restores the decreased brightness during the second light reaction interval to the default brightness, such that a user viewing the target region may indirectly realize the light reaction, thereby providing a realistic responses to the brightness of the image to the user.

The processor may maintain a brightness of the display without change in response to the difference between the viewpoint brightness information and the previous brightness information being less than the light reaction threshold and greater than or equal to the dark reaction threshold, or said another way, the processor may not charge the brightness of the display if the difference meets the dark reaction threshold, but fails to meet the light reaction threshold.

Figure 5:
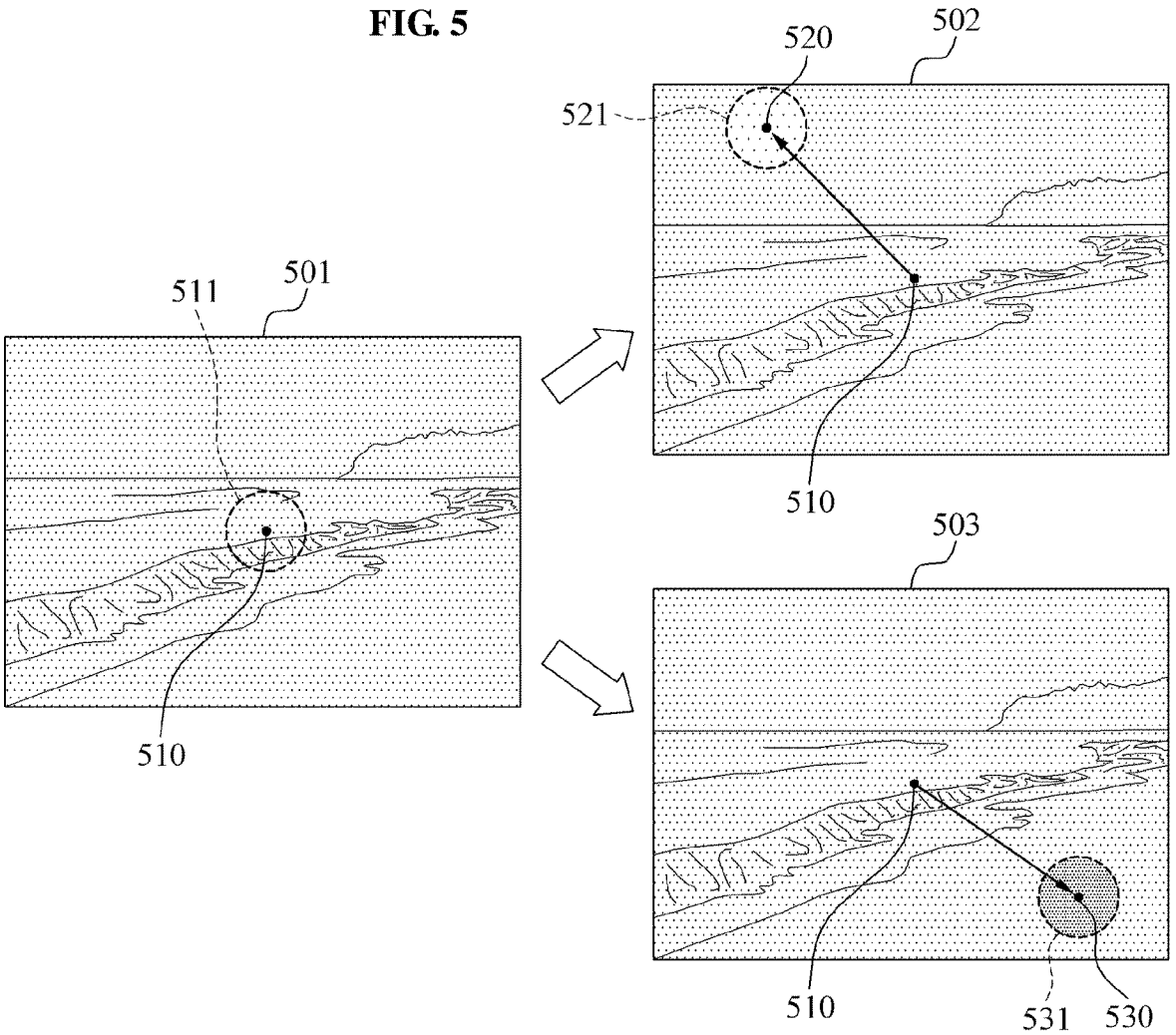
FIG. 5 illustrates adjusting of a brightness of a display according to one or more embodiments.

FIG. 5 illustrates an example of adjusting a brightness of a display in accordance with an embodiment.

FIG. 5 illustrates an example in which a processor adjusts a brightness of at least a partial region, for example, a target region of a display including a viewpoint region based on the method described with reference to FIG. 4. FIG. 5 illustrates that the target region is identical or substantially similar to the viewpoint region, however, the target region is not limited thereto. A size and a form of the target region may be set differently from that of the viewpoint region as desired. FIG. 5 illustrates that a user's viewpoint on the display moves with respect to a single image, however, the viewpoint is not limited thereto. The processor may similarly adjust the brightness in a case in which an image is a video and a frame is changed. In another example, in a condition in which a viewpoint of the user is fixed, a viewpoint of a camera that photographed the video or a virtual camera viewpoint of a rendered video may change.

For example, in the images including beaches illustrated in FIG. 5, it is assumed that a brightness of a region corresponding to sky is generally high, and a brightness of a region corresponding to land is generally low.

In an example, in response to the viewpoint moving from a previous viewpoint 510 (illustration 501) to a current viewpoint 520 (illustration 502), the processor compares viewpoint brightness information on a current viewpoint region 521 corresponding to the current viewpoint 520 to previous brightness information on a viewpoint region 511 with respect to a previous timing, such as described in operation 431 in FIG. 4. The illustration 502 in FIG. 5 demonstrates an example in which a brightness difference between the previous brightness information and the viewpoint brightness information is greater than a light reaction threshold. As described in operation 433 of FIG. 4, for example, the processor temporarily increases a brightness of the current viewpoint region 521. Subsequently, the processor restores the brightness of the current viewpoint region 521 to a default brightness by gradually decreasing the brightness of the current viewpoint region 521. In response to the restoring being completed, the brightness of the current viewpoint region 521 may be identical, or substantially similar to a brightness of the viewpoint region 511 in illustration 501. For example, the brightness of viewpoint region 511 in illustration 501 may represent a default brightness value or the default brightness may be a set or determined normalized or acclimated brightness for whichever viewpoint of the display the user is focused on.

In an example, in response to the viewpoint moving from the previous viewpoint 510 to a current viewpoint 530, demonstrated in illustration 503, the processor compares viewpoint brightness information on a current viewpoint region 531 to the previous brightness information on the previous viewpoint region 511 as described in operation 431 of FIG. 4. A right lower image 503 in FIG. 5 illustrates a case in which a brightness difference between the previous brightness information and the viewpoint brightness information being less than a dark reaction threshold. As described in operation 432 of FIG. 4, for example, the processor temporarily decreases the brightness of the current viewpoint region 531, and a moment at which the brightness of the current viewpoint region 531 decreases is illustrated in the right lower image 503. Subsequently, the processor may restore the brightness of the current viewpoint region 531 to a default brightness by gradually increasing the brightness of the current viewpoint region 531. In response to the restoring being completed, the brightness of the current viewpoint region 531 may be identical, or substantially similar to, the brightness of the viewpoint region 511 in illustration 501.

Accordingly, FIG. 5 illustrates that brightness changes of the current viewpoint regions 521 and 531 are oppositely applied to corresponding regions in potentially similar proportions, however, brightness changes are not limited thereto. For example, the processor may largely increase or decrease the brightness at the current viewpoint 520, so increases or decreases in brightness may not be identical for similar differences in brightness between current and previous timings. The processor may increase or decrease a brightness such that an instant difference in brightness is gradually reduced in proportion to an increase in a distance from the current viewpoint 520 to an outer boundary of the current viewpoint region 521 or to neighboring regions of the current viewpoint region 521. Therefore, a sense of disharmony of the current viewpoint region 521 and other regions may be reduced. The foregoing example may also be similarly or identically applied to the current viewpoint 530 and the current viewpoint region 531.

Figure 6:
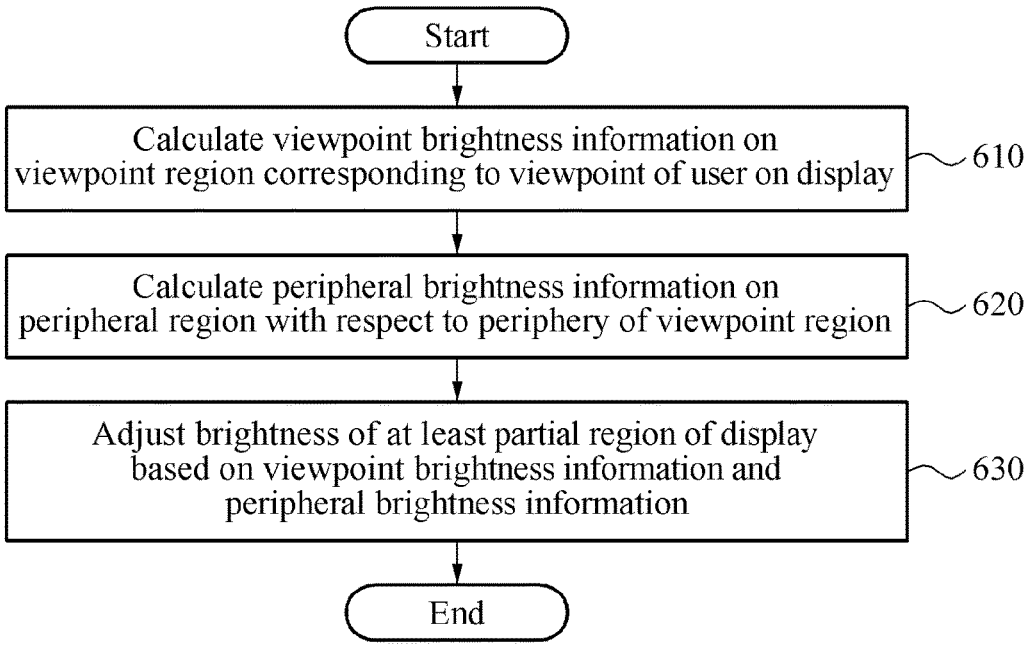
FIGS. 6 and 7 are flowcharts illustrating methods of adjusting a brightness of a display respectively according to one or more embodiments.
Figure 7:
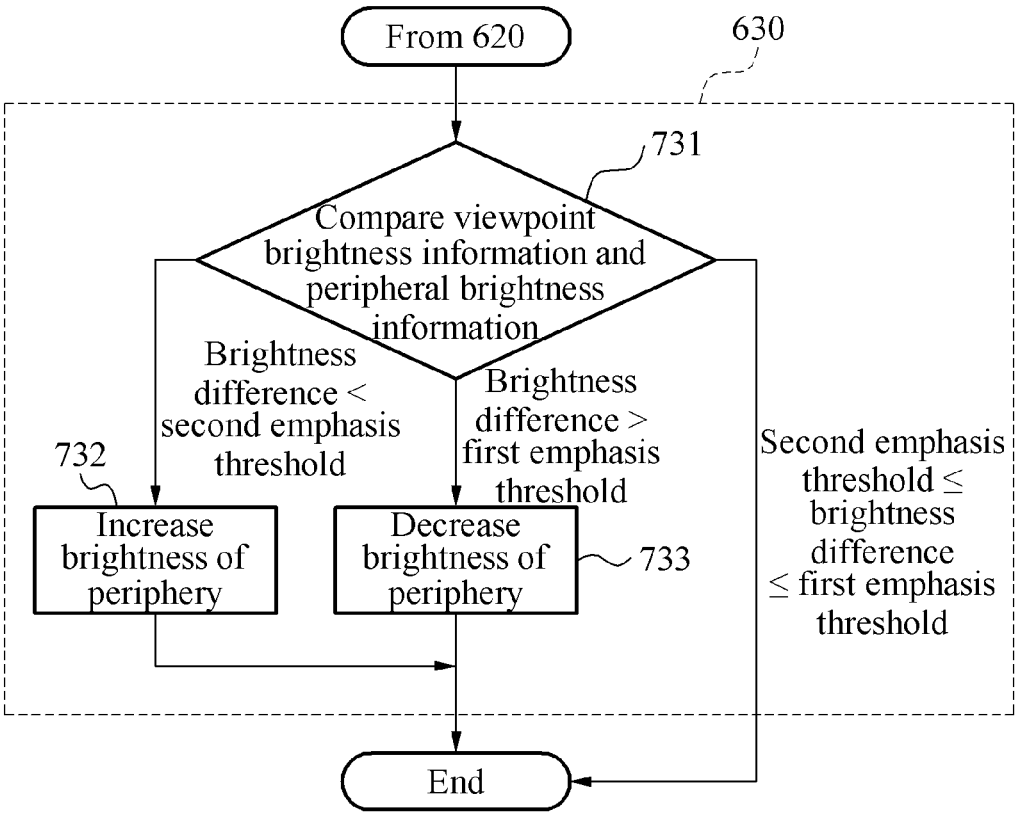

FIGS. 6 and 7 are flowcharts illustrating examples of a method of adjusting a brightness of a display in accordance with an embodiment.

FIG. 6 illustrates an example of the method of adjusting a brightness of a display.

In operation 610, a processor of a display brightness adjusting device calculates viewpoint brightness information on a viewpoint region corresponding to a viewpoint of a user on the display. For example, the processor may calculate the viewpoint brightness information in a way similar to operation 310 illustrated in FIG. 3.

In operation 620, the processor calculates peripheral brightness information on a peripheral region with respect to a periphery of the viewpoint region.

The peripheral region refers to a periphery of the viewpoint region and may be set to be various sizes and forms. The peripheral region may refer to an outside of, or beyond, the viewable display area, as the periphery of the viewpoint region in an image. For example, in a case of the display brightness adjusting device being a helmet mounted display (HMD), a display of the HMD may be a viewpoint region, and a predetermined region of a peripheral image which is not represented by the HMD may be a peripheral region. In other words, the peripheral region may include an area beyond or outside of the viewable display area, such as in the surrounding environment of the user. The peripheral region may also refer to areas of the display outside of a partial region or viewpoint region area of the display.

The peripheral brightness information may be referred to as information on a brightness of pixels corresponding to the peripheral region along the periphery of the viewpoint region. For example, the peripheral brightness information may be a statistical or numerical value of the brightness of the pixels corresponding to the peripheral region.

In operation 630, the processor adjusts a brightness of at least a partial region of the display based on the viewpoint brightness information and the peripheral brightness information. An example of such brightness adjustment based on the viewpoint brightness information and the peripheral brightness information will be described with reference to FIG. 7.

The processor may perform the aforementioned method of FIG. 6, however, it is not limited thereto. The processor may also perform the method of FIG. 6 by combining the method of FIG. 3 and the method of FIG. 4. For example, the processor may adjust the brightness of the target region including the viewpoint region based on the viewpoint brightness information and the previous brightness information based on the methods of FIGS. 3 and 4. The processor may also calculate the peripheral brightness information and adjust the brightness of the peripheral region based on the viewpoint brightness information and the peripheral brightness information based on the methods of FIGS. 6 and 7 in addition to the methods of FIGS. 3 and 4.

FIG. 7 is a flowchart illustrating the method of adjusting the brightness of at least a partial region of the display based on the viewpoint brightness information and the peripheral brightness information in operation 630 of FIG. 6.

In operation 731, the processor compares the viewpoint brightness information and the peripheral brightness information. For example, the processor calculates a difference between the viewpoint brightness information and the peripheral brightness information and compares the difference to a threshold or threshold value. Referring to FIG. 7, the threshold includes a first emphasis threshold and a second emphasis threshold. The processor performs the brightness adjustment to emphasize a physiological feature of an eye of a human body recognizing a viewpoint region to have a relatively low brightness compared to a peripheral region in response to the difference between the viewpoint brightness information and the peripheral brightness information being less than the second emphasis threshold. The processor performs the brightness adjustment to emphasize a physiological feature of the eye recognizing the viewpoint region to have a relatively high brightness compared to the peripheral region in response to the difference being greater than the first emphasis threshold.

In operation 732, the processor increases the brightness of at least a partial region of the display in response to the difference between the viewpoint brightness information and the peripheral brightness information being less than the second emphasis threshold. The processor maintains the increased brightness of the peripheral region during a display of the at least a partial region.

In an example, the processor adjusts the peripheral region as the at least a partial region. The processor increases and maintains the brightness of the peripheral region such that a user viewing the viewpoint region may exaggeratedly realize a phenomenon of realizing the viewpoint region to have a relatively low brightness in response to a periphery having a relatively high brightness, thereby providing a realistic image to the user.

In operation 733, the processor decreases the brightness of at least a partial region of the display in response to the difference between the viewpoint brightness information and the peripheral brightness information being greater than the first emphasis threshold. The processor maintains the decreased brightness of the at least a partial region during the display of the at least a partial region.

In an example, the processor adjusts the brightness of the peripheral region as the at least a partial region. The processor decreases and maintains the brightness of the peripheral region such that the user viewing the viewpoint region may exaggeratedly realize a phenomenon of realizing the viewpoint region to have a relatively high brightness in response to a periphery having a relatively low brightness.

The processor maintains the brightness of the peripheral region without a change, in response to the difference between the viewpoint brightness information and the peripheral brightness information being less than or equal to the first emphasis threshold and being greater than or equal to the second emphasis threshold.

Figure 8:
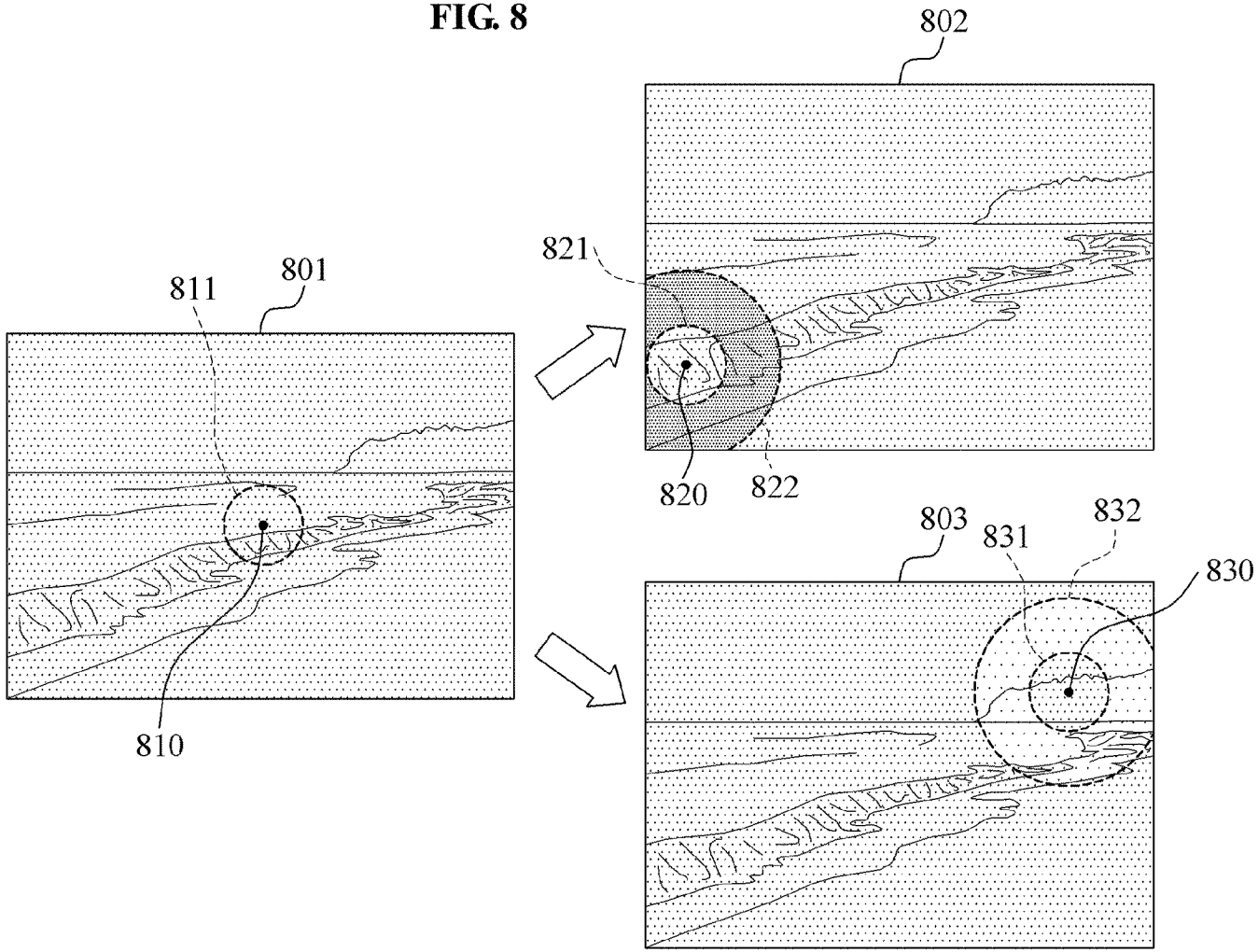
FIG. 8 illustrates an adjusting of a brightness of a display according to one or more embodiments.

FIG. 8 illustrates an example of adjusting a brightness of a display in accordance with one or more embodiments.

FIG. 8 illustrates an example of adjusting the at least a partial region, for example, a peripheral region, based the aforementioned method with reference to FIG. 7. However, the peripheral region is not limited to examples illustrated in FIG. 8, and sizes and forms of the peripheral region may be variously set as desired.

In an example, at a predetermined viewpoint 810 in illustration 801 of FIG. 8, a processor may not change the brightness of the peripheral region in response to a brightness difference between a viewpoint region 811 and the peripheral region being less than or equal to a first emphasis threshold and being greater than or equal to a second emphasis threshold. Illustration 802 demonstrates an example of changing the brightness of the peripheral region.

As an example, as illustrated in the illustration 802 of FIG. 8, a brightness difference between a viewpoint region 821 and a peripheral region 822 is greater than the first emphasis threshold at the viewpoint 820. The processor may decrease a brightness of the peripheral region 822 as described in operation 733 of FIG. 7, for example.

In another example, as demonstrated in illustration 803 of FIG. 8, a brightness difference between a viewpoint region and a peripheral region 832 is less than the second emphasis threshold at the viewpoint 830. The processor may increase the brightness of the peripheral region as described in operation 732 of FIG. 7, for example.

FIG. 8 illustrates that brightness changes of the peripheral regions 822 and 832 are oppositely applied to corresponding regions in potentially similar proportions, however, the brightness changes are not limited thereto. For example, the processor may increase or decrease a brightness such that a difference in brightness is gradually reduced in proportion to the increase in distance to an outer boundary of the peripheral region 822 or in proportion to the distance from the center of the viewpoint 820. Therefore, a sense of disharmony of the peripheral region 822 and other regions may be reduced. The foregoing example may also be similarly or identically applied to the peripheral region 832.

FIG. 8 illustrates an example of the display changing the brightness of the peripheral region, however, the display is not limited thereto. As illustrated in FIG. 5, the processor may change a brightness of a viewpoint region, and concurrently change a brightness of a peripheral region.

Figure 9:
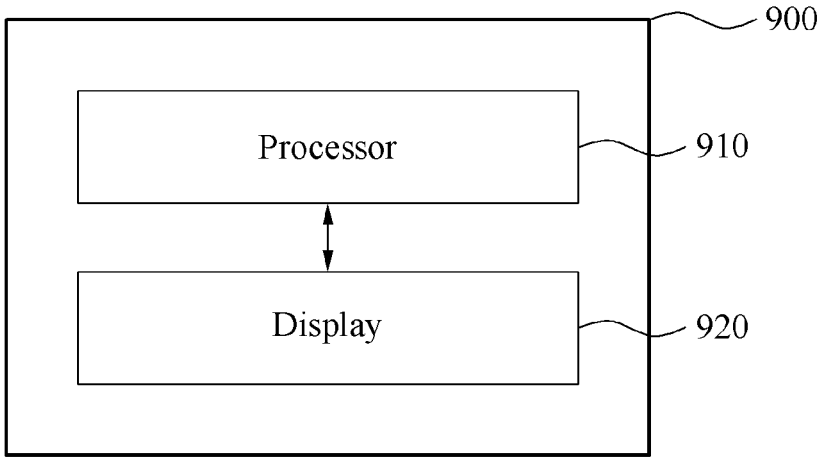
FIGS. 9 and 10 are block diagrams illustrating devices for adjusting a brightness of a display respectively according to one or more embodiments.
Figure 10:
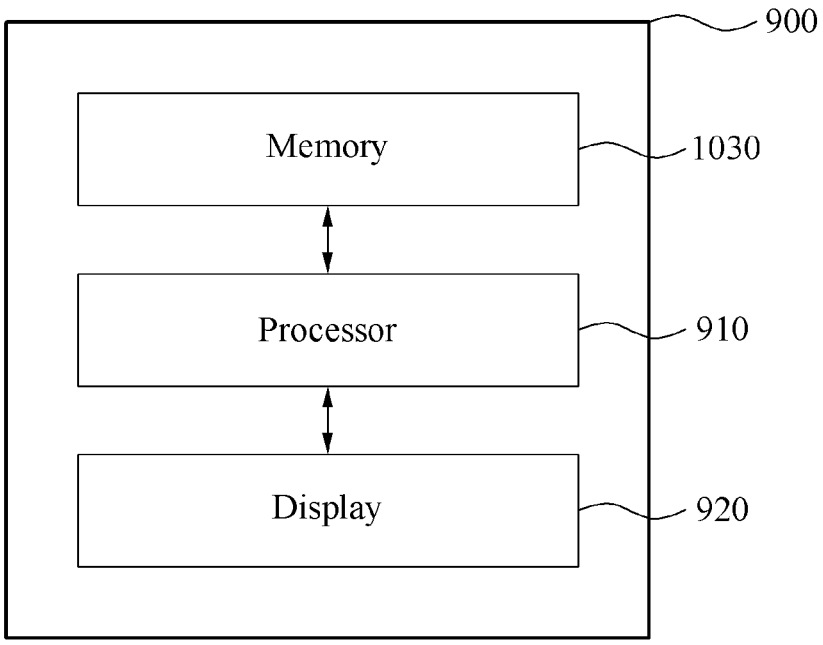

FIGS. 9 and 10 are block diagrams illustrating an example of a display brightness adjusting device in accordance with one or more embodiments.

A display brightness adjusting device 900 includes a processor 910 and a display 920. The processor 910 calculates viewpoint brightness information on a viewpoint corresponding to a viewpoint of a user on the display 920, calculates previous brightness information on a viewpoint region at a previous timing, and adjusts a brightness of at least a partial region of the display 920 based on the calculated viewpoint brightness information and the previous brightness information.

The processor 910 calculates the viewpoint brightness information on the viewpoint region corresponding to the viewpoint of the user on the display 920, calculates peripheral brightness information on a peripheral region with respect to a periphery of the viewpoint region, and adjusts the brightness of at least a partial region of the display 920 based on the viewpoint brightness information and the peripheral brightness information.

The display 920 displays an image. The processor 910 controls the display 920 to adjust a brightness according to a brightness of a predetermined region of the image.

The display brightness adjusting device 900 further includes a memory 1030. The memory 1030 stores a program including instructions to perform any or any combination of the methods of FIGS. 3-8. In an embodiment, the memory 1030 may semipermanently or temporarily store data including viewpoint brightness information, peripheral brightness information, previous brightness information, and a brightness difference made available for performing, by the processor 910, any or any combination of the aforementioned methods of adjusting a brightness of the display 920.

The display brightness adjusting device 900 may further include a sensor 930 to track a head and a sensor track a gaze or eyes of the user. The sensor 930 to track a head may track a head movement of a user through a camera, or may be mounted to the head of the user to track the head movement by measuring acceleration in a case of a head mounted display (HMD). The sensor 930 may track the gaze and may be a camera, as an example, to track a movement of a pupil.

The display brightness adjusting device 900 may be incorporated into, or be, a virtual reality (VR) device, an augmented reality (AR) device or another electronic device to which a display, for example, a smartphone or a tablet personal computer (PC), is attached.

The display brightness adjusting device 900 allows the user to realize a sense of reality while the user is viewing an image by forcibly compensating, to a display, a change in time adaption based on a brightness change and a difference in contrast with a color distribution on a peripheral space. For example, the display brightness adjusting device 900 may provide a realistic image by forcibly compensating light intensity by applying a time adaption, a dark reaction and a light reaction, corresponding to physiological reactions of a visual cells to a brightness change in response to a viewpoint changed to a display portion having a relatively high brightness and a display portion having a relatively low brightness in an image. Therefore, the display brightness adjusting device 900 may compare a brightness at a current viewpoint to a brightness at a previous viewpoint and apply a brightness effect with respect to the current viewpoint, thereby maximizing the brightness effect to be brighter than an actual brightness.

The display brightness adjusting device 900 may compensate a relative difference in contrast with a color distribution on a space by adjusting a brightness of a region corresponding to the current viewpoint to have a relatively high brightness or have a relatively low brightness compared to that of a peripheral viewpoint viewing a peripheral brightness, such as with respect to an underexposure or an overexposure by a light intensity generated when a portion having a relatively high brightness or a portion having a relatively low brightness is photographed. Therefore, the display brightness adjusting device 900 may represent the current viewpoint to have a relatively high brightness or a relatively low brightness by darkening or brightening the peripheral viewpoint.

The apparatuses, units, modules, devices, and other components illustrated in FIGS. 1, 9, and 10 that perform the operations described herein with respect to FIGS. 2-8 are implemented by hardware components. Examples of hardware components include controllers, sensors, generators, drivers, memories, comparators, arithmetic logic units, adders, subtractors, multipliers, dividers, integrators, and any other electronic components known to one of ordinary skill in the art. In one example, the hardware components are implemented by computing hardware, for example, by one or more processors or computers. A processor or computer is implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices known to one of ordinary skill in the art that is capable of responding to and executing instructions in a defined manner to achieve a desired result. In one example, a processor or computer includes, or is connected to, one or more memories storing instructions or software that are executed by the processor or computer. Hardware components implemented by a processor or computer execute instructions or software, such as an operating system (OS) and one or more software applications that run on the OS, to perform the operations described herein with respect to FIGS. 2-8. The hardware components also access, manipulate, process, create, and store data in response to execution of the instructions or software. For simplicity, the singular term "processor" or "computer" may be used in the description of the examples described herein, but in other examples multiple processors or computers are used, or a processor or computer includes multiple processing elements, or multiple types of processing elements, or both. In one example, a hardware component includes multiple processors, and in another example, a hardware component includes a processor and a controller. A hardware component has any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

The methods illustrated in FIGS. 2-8 that perform the operations described herein with respect to FIGS. 2-8 are performed by a processor or a computer as described above executing instructions or software to perform the operations described herein.

Instructions or software to control a processor or computer to implement the hardware components and perform the methods as described above are written as computer programs, code segments, instructions or any combination thereof, for individually or collectively instructing or configuring the processor or computer to operate as a machine or special-purpose computer to perform the operations performed by the hardware components and the methods as described above. In one example, the instructions or software include machine code that is directly executed by the processor or computer, such as machine code produced by a compiler. In another example, the instructions or software include higher-level code that is executed by the processor or computer using an interpreter. Programmers of ordinary skill in the art can readily write the instructions or software based on the block diagrams and the flow charts illustrated in the drawings and the corresponding descriptions in the specification, which disclose algorithms for performing the operations performed by the hardware components and the methods as described above.

The instructions or software to control a processor or computer to implement the hardware components and perform the methods as described above, and any associated data, data files, and data structures, are recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMS, BD-ROMs, BD-Rs, BD-R LTHs, BD-REs, magnetic tapes, floppy disks, magneto-optical data storage devices, optical data storage devices, hard disks, solid-state disks, and any device known to one of ordinary skill in the art that is capable of storing the instructions or software and any associated data, data files, and data structures in a non-transitory manner and providing the instructions or software and any associated data, data files, and data structures to a processor or computer so that the processor or computer can execute the instructions. In one example, the instructions or software and any associated data, data files, and data structures are distributed over network-coupled computer systems so that the instructions and software and any associated data, data files, and data structures are stored, accessed, and executed in a distributed fashion by the processor or computer.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A method of adjusting a brightness of a display, the method comprising:

determining current viewpoint brightness information of a current viewpoint region on the display corresponding to a user's current viewed point of the display or current viewed area of the display;

determining previous brightness information of a previous viewpoint region of the display corresponding to a previously viewed point of the display or previously viewed area of the display; and controlling a displaying of a current image, including the current viewpoint region, with an adjusted brightness for a partial region of the display based on a comparison of the current viewpoint brightness information and the previous brightness information.

2. The method of claim 1, further comprising adjusting the brightness for the partial region, including temporarily increasing the brightness of the partial region of the display in response to a difference between the current viewpoint brightness information and the previous brightness information meeting a light reaction threshold.

3. The method of claim 2, wherein the temporary increasing of the brightness of the partial region comprises:

increasing the brightness of the partial region to a first amount beginning in a first light reaction interval; and gradually adjusting the brightness of the partial region to a default brightness during a second light reaction interval, after the first light reaction interval, longer than the first light reaction interval.

4. The method of claim 1, further comprising adjusting the brightness for the partial region, including temporarily decreasing the brightness of the partial region of the display in response to a difference between the current viewpoint brightness information and the previous brightness information not meeting a dark reaction threshold.

5. The method of claim 4, wherein the temporary decreasing of the brightness of the partial region comprises:

decreasing the brightness of the partial region to a first amount beginning in a first dark reaction interval; and gradually adjusting the brightness of the partial region to a default brightness during a second dark reaction interval, after the first dark reaction interval, longer than the first dark reaction interval.

6. The method of claim 1, further comprising:

determining peripheral brightness information of a peripheral region, as the partial region, that is peripheral to the current viewpoint region, wherein the controlling of the displaying of the current image with the adjusted brightness comprises adjusting a brightness of the peripheral region based on a comparison of the current viewpoint brightness information and the peripheral brightness information.

7. The method of claim 6, wherein the adjusting of the brightness of the peripheral region comprises decreasing the brightness of the peripheral region in response to a difference between the current viewpoint brightness information and the peripheral brightness information meeting a first emphasis threshold.

8. The method of claim 7, wherein the controlling of the displaying of the current image further includes controlling a displaying of a sequence of frames while maintaining a result of the decreasing of the brightness of the peripheral region until the peripheral region is no longer displayed or a viewpoint of the viewer changes.

9. The method of claim 6, wherein the adjusting of the brightness of the peripheral region comprises increasing the brightness of the peripheral region in response to a difference between the current viewpoint brightness information and the peripheral brightness information failing to meet a second emphasis threshold.

10. The method of claim 9, wherein the controlling of the displaying of the current image further includes controlling a displaying of a sequence of frames while maintaining a result of the increasing of the brightness of the peripheral region until the peripheral region is no longer displayed or a viewpoint of the viewer changes.

11. The method of claim 1, further comprising adjusting the brightness for the partial region, including adjusting a brightness of a target region that includes the viewpoint region.

12. The method of claim 1, further comprising:

determining the user's current viewed point of the display or current viewed area of the display by tracking a head and/or a gaze of the user; and determining the current viewpoint region based on the determined user's current viewed point or current viewed area.

13. A non-transitory computer-readable medium storing instructions that, when executed by one or more processors, cause the one or more processors to perform the method of claim 1.

14. The method of claim 1, wherein the current viewpoint region is an area on the display that is determined based on a tracked view of the user at a current timing.

15. A device for displaying a brightness of a display, the device comprising:

a display configured to display plural images; and a processor configured to determine current viewpoint brightness information of a current viewpoint region on the display corresponding to a user's current viewed point of the display or current viewed area of the display, determine previous brightness information of a previous viewpoint region of the display corresponding to a previously viewed point of the display or previously viewed area of the display, and to provide for the display a current image, including the current viewpoint region, with an adjusted brightness for a partial region of the display based on a comparison of the current viewpoint brightness information and the previous brightness information.

16. A method of adjusting a brightness of a display, the method comprising:

determining, in response to a viewpoint moving from a previous viewpoint to a current viewpoint, current viewpoint brightness information of a current viewpoint region on the display corresponding to a user's current viewed point of the display or current viewed area of the display;

determining peripheral brightness information on a peripheral region that is peripheral to the current viewpoint region; and controlling a displaying of a current image, including the current viewpoint region and the peripheral region, with an adjusted a-brightness of a partial region of the display based on a comparison of the current viewpoint brightness information and the peripheral brightness information, wherein the user's current viewed point or current viewed area is determined by tracking one or more of the eyes of the user and a head of the user.

17. The method of claim 16, further comprising adjusting the brightness of the partial region, including decreasing the brightness of the partial region in response to a difference between the current viewpoint brightness information and the peripheral brightness information meeting a first emphasis threshold.

18. The method of claim 17, wherein the controlling of the displaying of the current image further includes controlling a displaying of a sequence of frames while maintaining a result of the decreasing of the brightness of the partial region until the partial region is no longer displayed.

19. The method of claim 16, further comprising adjusting the brightness of the partial region, including increasing the brightness of the partial region in response to a difference between the current viewpoint brightness information and the peripheral brightness information not meeting a second emphasis threshold.

20. The method of claim 19, wherein the controlling of the displaying of the current image further includes controlling a displaying of a sequence of frames while maintaining a result of the increasing of the brightness of the partial region until the partial region is no longer displayed.

21. The method of claim 16, further comprising adjusting the brightness of the partial region, where the partial region is the peripheral region.

22. The method of claim 16, wherein a brightness of the peripheral region is selectively changed based on a brightness difference between the current viewpoint region and the peripheral region being less than or equal to a first emphasis threshold, or a brightness difference between the current viewpoint region and the peripheral region being greater than or equal to a second emphasis threshold.

* * * * *